United States Patent [19]

Lewis et al.

[11] 3,930,475

[45] Jan. 6, 1976

[54] ENGINE EXHAUST GAS RECIRCULATING CONTROL

[75] Inventors: John A. Lewis, Detroit; John R. Marshall, Novi, both of Mich.

[73] Assignee: Ford Motor Company, Dearborn, Mich.

[22] Filed: Aug. 24, 1973

[21] Appl. No.: 391,411

[52] U.S. Cl. ..... 123/119 A; 123/119 A

[51] Int. Cl. ..... F02m 25/06

[58] Field of Search ..... 123/119 A

[56] References Cited

UNITED STATES PATENTS

| | | | |
|---|---|---|---|
| 3,542,004 | 11/1970 | Cornelius | 123/119 A |
| 3,713,428 | 1/1973 | Sandhagen | 123/119 A |
| 3,717,131 | 2/1973 | Chana et al. | 123/119 A |
| 3,741,179 | 6/1973 | Vartanian | 123/119 A |
| 3,768,452 | 10/1973 | Lewis | 123/119 A |
| 3,774,583 | 11/1973 | King | 123/119 A |
| 3,783,847 | 1/1974 | Kolody | 123/119 A |
| 3,800,765 | 4/1974 | Thompson | 123/119 A |

*Primary Examiner*—Wendell E. Burns
*Attorney, Agent, or Firm*—Robert E. McCollum; Keith L. Zerschling

[57] ABSTRACT

The engine has a duct connecting the gases in the exhaust gas crossover passage to the intake manifold, the duct normally being closed by a valve that is opened by manifold vacuum that is modulated as a function of carburetor throttle blade opening and connected to the duct past an air-bleed device that normally is open and closed against a spring force by unmodulated manifold vacuum below a predetermined level so that the gas recirculating valve opening signal force varies directly with manifold vacuum decreases to prevent recirculation during engine idle and cruising and wide-open throttle operations while providing controlled operation in the engine accelerating range between.

10 Claims, 2 Drawing Figures

ENGINE EXHAUST GAS RECIRCULATING CONTROL

Figures 1, 2:
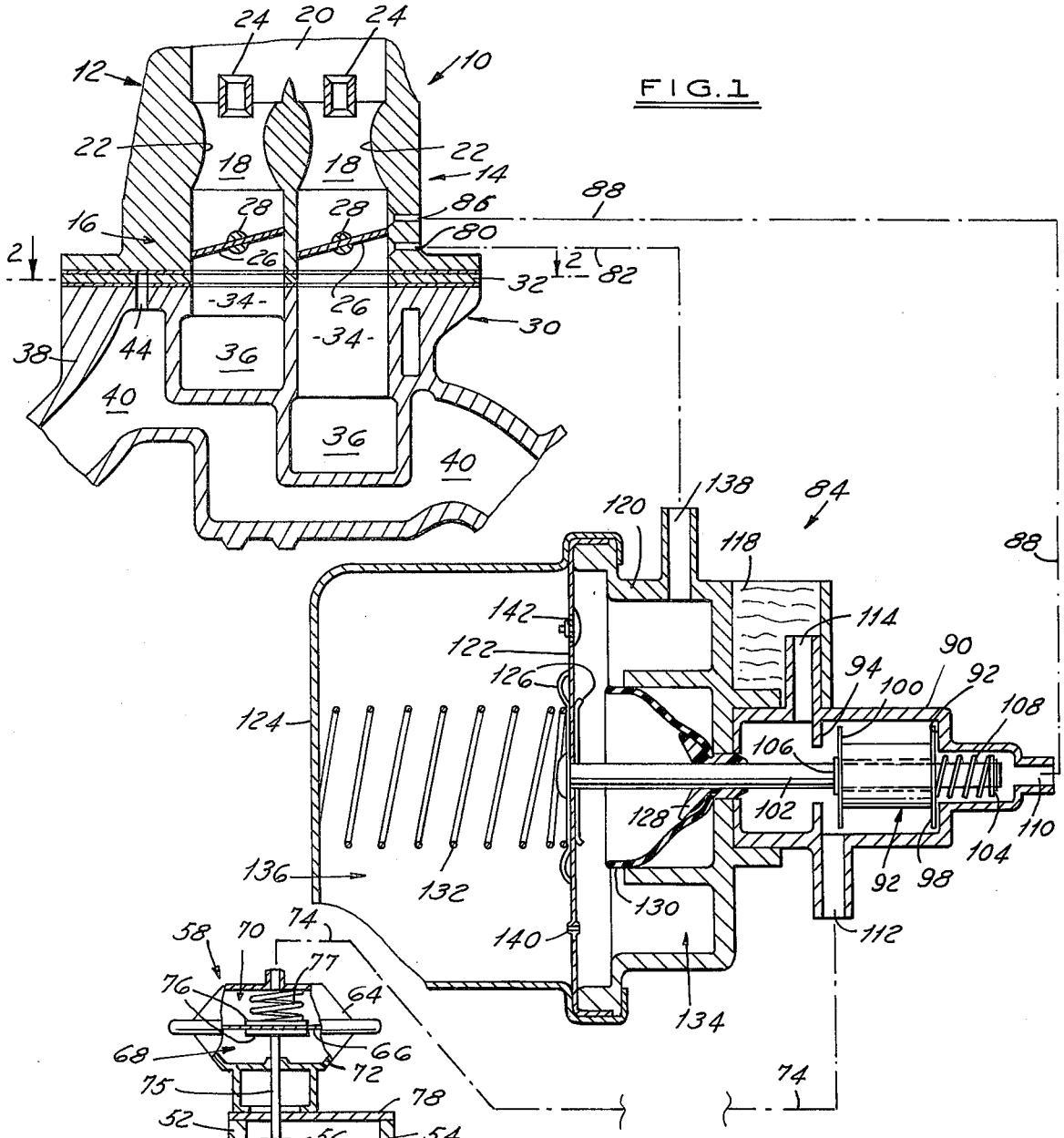

This invention relates, in general, to an internal combustion engine. More particularly, it relates to a system for controlling the recirculation of exhaust gases back into the engine through the intake manifold.

Devices are known for recirculating a portion of the engine exhaust gases back through the engine to control the emission of unburned hydrocarbons and lower the output of oxides of nitrogen. These devices have included valving to prevent recirculation of the exhaust gases at undesired times and generally are controlled by movement of the carburetor throttle valve so that recirculation is prevented during engine idle and wide-open throttle operations. This is desirable because at engine idle, exhaust gas scavenging is inefficient, while at wide-open throttle position, maximum power is limited by the availability of oxygen.

It is an object of this invention to provide an exhaust gas recirculating system that affords a finer control of the recirculation of gases back into the engine by means of a pilot valve type operation rather than by the single control valve known in the prior art.

Another object of the invention is to provide selective control of exhaust gas recirculating flow of an engine in responses to changes in intake manifold vacuum level modulated as a function of engine load indicated by throttle valve position.

It is a still further object of the invention to provide a valve for opening and closing a duct containing exhaust gases for recirculation into an engine, the valve being moved to open the duct by a force that is determined by manifold vacuum level and is proportional to changes in manifold vacuum modulated by the carburetor throttle valve.

Other objects, features and advantages of the invention would become more apparent upon reference to the succeeding detailed description thereof, and to the drawings illustrating a preferred embodiment thereof, wherein;

FIG. 1 is a cross-sectional view of a portion of an internal combustion engine and associated carburetor embodying the invention; and, FIG. 2 is a cross-sectional view taken on a plane indicated by and viewed in the direction of the arrows 2—2 of FIG. 1.

FIG. 1 illustrates a portion 10 of one-half of a four-barrel carburetor of a known downdraft type. It has an air horn section 12, a main body portion 14, and a throttle body 16, joined by suitable means not shown. The carburetor has the usual air/fuel induction passages 18 open at their upper ends 20 to fresh air from the conventional air cleaner, not shown. The passages 18 have the usual fixed area venturies 22 cooperating with booster venturies 24 through which the main supply of fuel is induced, by means not shown.

Flow of air and fuel through induction passages 18 is controlled by a pair of throttle valve plates 26 each fixed on a shaft 28 rotatably mounted in the side walls of the carburetor body.

The throttle body 16 is flanged as indicated for bolting to the top of the engine intake manifold 30, with a spacer element 32 located between. Manifold 30 has a number of vertical risers or bores 34 that are aligned for cooperation with the discharge end of the carburetor induction passages 18. The risers 34 extend at right angles at their lower ends 36 for passage of the mixture out of the plane of the figure to the intake valves of the engine.

The exhaust manifolding part of the engine cylinder head is indicated partially at 38, and includes an exhaust gas crossover passage 40. The latter passes from the exhaust manifold, not shown, on one side of the engine to the opposite side beneath the manifold trunks 36 to provide the usual "hot spot" beneath the carburetor to better vaporize the air/fuel mixture.

As best seen in FIG. 2, the spacer 32 is provided with a worm-like recess 42 that is connected directly to crossover passage 40 by a bore 44. Also connected to passage 42 is a passage 46 alternately blocked or connected to a central bore or passage 48 communicating with the risers 34 through a pair of ports 50. Mounted to one side of the spacer is a cup shaped boss 52 forming a chamber 54 through which passages 46 and 48 are interconnected.

As described above, it is necessary and desirable to provide some sort of control to prevent the recirculation of exhaust gases at undesirable times. For this purpose, passage 46 normally is closed by a valve 56 that is moved to an open position by a servo 58. The servo includes a hollow outer shell 64 containing an annular flexible diaphragm 66. The latter divides the interior into an air chamber 68 and a signal vacuum chamber 70. Chamber 68 is connected to atmospheric pressure through a vent 72, while chamber 70 is connected to a vacuum signal force through a line 74. The stem 75 of valve 56 is fixed to a pair of retainers 76 secured to diaphragm 66. They serve as a seat for a compression spring 77 normally biasing the valve to its closed position. The stem slidably and sealingly projects through a plate 78 closing chamber 54.

As shown in FIG. 1, the carburetor contains a manifold vacuum sensing port 80 connected by a line 82 and an air-bleed device 84 to the vacuum signal line 74. The carburetor also contains an exhaust gas recirculating (EGR) port 86 that is located above the port 80 and above the closed position of throttle valve 26 to be traversed by the edge of the throttle valve as it moves open. The pressure in port 86 thereby varies from atmospheric to the manifold vacuum level as a function of the opening of throttle valve 28. Port 86 is connected to a passage 88.

Device 84 in this case is manifold vacuum controlled to control the flow of EGR vacuum to servo 58. More specifically, device 84 includes a lower valve body portion 90 having a pair of opposite valve seats 92 and 94. Alternately seated against each valve seat is a reciprocatable spool type valve 96 having valve closure lands 98 and 100. The valve is slidably mounted on a shaft or plunger 102 between a pair of stops or locaters 104 and 106. A light positioning spring 108 biases the valve upwardly against stop 106. The valve body 90 has three ports 110, 112 and 114. Port 110 is connected by passage 88 to the EGR port 86. Port 112 is connected by passage 74 to servo 58. Port 114 is an air bleed port and is connected to atmosphere through an opening 118 in the valve body.

The lower valve body portion 90 has a press fit within a cup-shaped servo housing 120. The housing is closed by a flexible annular diaphragm 122 edge mounted to the body by a cap 124. The plunger 102 is riveted to the diaphragm through a pair of retainers 126.

Plunger 102 projects sealingly through body 120 through a rubber seal 128 and a rubber boot 130. A spring 132 normally biases the plunger and valve 96 downwardly to air bleed position blocking EGR vacuum communication between passages 88 and 74.

The diaphragm 122 defines on opposite sides a vacuum chamber 134 and a reservoir chamber 136. Chamber 134 is connected by a side port 138 and passage 82 to manifold vacuum port 80. Chamber 136 communicates with chamber 134 through a flow restricting orifice 140 and a one-way check valve 142 in diaphragm 122. Lower pressure in chamber 134 than chamber 136 will unseat check valve 142 to immediately equalize the pressures in the two chambers, whereas a lower pressure in chamber 136 than in chamber 134 will permit slow equalization only through orifice 140.

Before proceeding to a description of the operation of the invention, it should be noted that the force of spring 132 is chosen such that below a vacuum force of say seven inches hg., for example, the spring will maintain the bleed valve 96 in a bleed position. Servo spring 77 normally would be a light spring, although it will be clear its force can be varied to vary operation of servo 58.

In operation, therefore, it is desirous that exhaust gas be recirculated essentially only during the heavier engine acceleration modes. The invention accomplishes this by providing an EGR vacuum signal force to servo 58 to open valve 56 that varies directly in proportion to the increase in vacuum in port 86 as sensed by the opening of the throttle valve 26.

After the engine is started, with the throttle valves 26 positioned as shown for idle speed operation, the manifold vacuum level in port 80 will be high and above seven inches hg. Accordingly, manifold vacuum acting in chamber 134 will immediately open check valve 142 and reduce the pressure in chamber 136 to that of chamber 134. The spring 132 maintains bleed valve 96 in the position shown. EGR passage 88 contains air at atmospheric pressure.

If now the vehicle is only lightly accelerated, rotation of throttle valve 26 will cause a slight level of vacuum in the EGR port 86, but also only a slight decay in manifold vacuum in port 80. This will not be sufficient to move bleed valve 96 if the manifold vacuum level remains above 7 inches hg. Assume now that the throttle valve is depressed for a rapid acceleration sufficient to decay manifold vacuum to a level where the increased pressure in chamber 134 is sufficient to overcome the force of spring 132. This will move diaphragm 122 upwardly since check valve 142 remains seated and bleed of air occurs only through orifice 140. The valve 96, therefore will move up and open to a degree dependent upon the force of spring 132 and the decay in the level of manifold vacuum to communicate the increased EGR vacuum in line 88 to the EGR servo 58. If the vacuum level is sufficient to overcome the force of spring 77, then valve 56 will open and recirculate the exhaust gases.

When the vehicle has reached its cruising condition, the throttle valves will be operating at slightly off idle position or slightly opened from the positions shown. The manifold vacuum, however, will be essentially at a maximum value and again cause a complete opening of air bleed valve 96. Check valve 142 will pop open to equalize the pressures in chambers 134 and 136, and spring 132 will again move valve 96 to the position shown cutting off EGR vacuum in line 88. This will provide essentially atmospheric pressure in the servo chamber 70 and maintain valve 56 closing passage 46.

Similarly, during a wide-open throttle condition of operation, a rapid opening of the throttle valves to their wide-open position indicating demand for maximum torque, will drop the manifold vacuum level essentially to zero. Even though diaphragm 122 may move upwardly and move valve 96 to close the air vent, the servo 58 will maintain valve 56 closed because EGR vacuum also is essentially zero. Thus, no recirculation of exhaust gases will occur until the vacuum level again builds up.

From the foregoing, it will be seen that the invention provides a selective control of exhaust gas recirculation through the use of a pilot valve controlled by manifold vacuum changes to modulate the level of manifold vacuum to the EGR valve. While the invention has been described and illustrated in its preferred embodiment, it will be clear to those skilled in the arts to which it pertains that many changes and modifications may be made thereto without departing from the scope of the invention.

We claim:

1. An exhaust gas recirculating system for an internal combustion engine, having a throttle valve controlling flow through a carburetor induction passage, comprising, a duct connecting the exhaust gases to the engine intake manifold, a second valve normally closing the duct to prevent recirculation and movable to an open position by a signal vacuum connected thereto, and control means responsive to changes in engine manifold vacuum action on the control means to communicate a signal force to the second valve that varies from an ambient essentially atmospheric pressure level at closed throttle positions to manifold vacuum levels at wide open throttle positions.

2. A system as in claim 1, including a vacuum servo connected to the second valve having spring means biasing the second valve to a position closing the duct.

3. A system as in claim 1, the control means including a line connecting modulated manifold vacuum to a signal force passage connected to the second valve, and a normally open air bleed valve connected to the passage movable by decay of manifold vacuum to a value below a predetermined manifold vacuum level to variably block the bleed of air into the line as a function of manifold vacuum decreases.

4. A system as in claim 1, the control means including a line connecting manifold vacuum modulated as a function of throttle valve position to a signal force passage connected to the second valve, and an air bleed device in the line movable between positions bleeding and not bleeding air into the line to vary the signal force in the manner indicated in claim 1, the air bleed device including an air bleed opening in the line, a valve movable in response to intake manifold vacuum changes to block the air bleed opening, and spring means biasing the air bleed valve open above a predetermined intake manifold vacuum level.

5. A system as in claim 2, including a first manifold vacuum port and a second signal vacuum port in the induction passage located respectively below and above the closed position of the throttle valve so as to subject the first port to manifold vacuum at all times and the second signal port to atmospheric pressure at closed throttle position and progressively to manifold vacuum as the throttle valve traverses the signal port, the manifold vacuum responsive means including a second valve spring moved in one direction and having a movement in the opposite direction triggered by manifold vacuum changes, the second valve movement controlling the flow of signal vacuum to the first mentioned valve.

6. A system as in claim 5, including a normally open air bleed associated with the signal vacuum port and closed by movement of the second valve in the opposite direction, movement of the second valve in the opposite direction connecting the signal vacuum to the first valve.

7. A system as in claim 5, the second valve comprising a shuttle valve, a normally open air bleed preventing application of signal vacuum to the first valve, the shuttle valve in one position maintaining the air bleed open while blocking connection of signal vacuum to the first valve, movement of the second valve to a second position in response to predetermined manifold vacuum changes blocking the air bleed while connecting the signal vacuum to the first valve to open the latter.

8. An exhaust gas recirculating system for an internal combustion engine having intake and exhaust manifolding and a carburetor with an induction passage connected to the intake manifold and having a throttle valve movable across the passage to open and close the passage to control the flow therethrough, a duct connecting the intake and exhaust manifolding for recirculating the exhaust gases back into the engine, a second valve movable between alternate positions to open and close the duct, a servo connected to the second valve and having spring means biasing the second valve to a closed position, a vacuum signal line connected to the second valve for moving the same to an open position, means connecting the vacuum signal line to a port in the induction passage located above the closed position of the throttle valve, and air bleed means in the signal line controlling the vacuum signal force in the signal line, the air bleed means including a normally open vent, an air bleed control valve movable to close or open the vent to control the level of transfer of manifold vacuum in the port to the signal line, spring means biasing the air bleed valve opened, and manifold vacuum operated servo means connected to the bleed valve for moving it to a closed vent position so that the vacuum signal force in the signal line varies with changes in intake manifold vacuum modulated by movement of the throttle valve whereby the exhaust gases are recirculated only during predetermined engine accelerative modes of operation.

9. A system as in claim 8, the servo means including a housing having a flexible diaphragm dividing the housing into a pair of chambers, means connecting maniford vacuum to one chamber, means connecting the air bleed valve to the diaphragm, spring means biasing the diaphragm and bleed valve to an open bleed position, orifice flow restriction means in the diaphragm permitting slow communication between the chambers, and one-way check valve means in the diaphragm permitting a rapid equalization of pressures at times between the chambers.

10. A system as in claim 9, the vacuum in the port being blocked from communication with the first mentioned valve when the bleed valve is in an open bleed position.

* * * * *